United States Patent [19]

Drummond

[11] Patent Number: 4,689,978

[45] Date of Patent: Sep. 1, 1987

[54] SIDE BAR WAFER LOCK, AN IMPROVED SPRING RETAINER FOR SAID LOCK, AND A METHOD OF USING SAID SPRING RETAINER IN SAID LOCK

[76] Inventor: Robert L. Drummond, 163 Woodlawn NW., Perry Heights, Canton, Ohio 44708

[21] Appl. No.: 923,766

[22] Filed: Oct. 27, 1986

[51] Int. Cl.[4] ..... E05B 17/00

[52] U.S. Cl. ..... 70/431; 70/372

[58] Field of Search ..... 70/370, 372, 373, 376, 70/377, 378, 374, 375, 431

[56] References Cited

U.S. PATENT DOCUMENTS 3,176,488 4/1965 Jacobi ..... 70/373

3,673,831 7/1972 Nelson ..... 70/373

*Primary Examiner*—Robert L. Wolfe

[57] ABSTRACT

An improvement in a side bar wafer lock, specifically an improvement in the spring retainer of such a lock, and a method of using the spring retainer in the lock are provided. The improved spring retainer of the invention is provided with barbs on the legs thereof such that when the spring retainer is inserted into the slots of the plug of the wafer lock, the barbs bite into the relatively soft metal of the plug to prevent the dislodging of the spring retainer. The method of the invention comprises the steps of forcing the spring retainer into slots in the plug and causing the barbs on the spring retainer to bite into the relatively soft metal of the plug, as opposed to the prior art method of swaging the plug.

17 Claims, 4 Drawing Figures

SIDE BAR WAFER LOCK, AN IMPROVED SPRING RETAINER FOR SAID LOCK, AND A METHOD OF USING SAID SPRING RETAINER IN SAID LOCKBACKGROUND OF THE INVENTION

The present invention relates to an improvement in a side bar wafer lock, an improvement in the spring retainer thereof, and a method of using the spring retainer in said lock.

Side bar wafer locks are most commonly used in the ignitions, doors and trunks of automobiles. The improved side bar wafer lock of the present invention is of a type that is most commonly used in General Motors, American Motors and some Chrysler cars.

A side bar wafer lock of the prior art comprises : 1 a cylindrical housing, which fits into the steering column, door or trunk and has a rectangular notch for receiving a side bar when in the locked condition, and 2. a cylindrical metal plug, which contains the side bar, side bar springs, tumblers and tumbler springs, which fits into the housing, and can be rotated therein, except when the side bar is in the rectangular notch, wherin the side bar springs tend to push the side bar inward and flush with the outside surface of the plug, and out of the rectangular notch, when the key is inserted in the lock, and the side bar, tumblers and tumbler springs have a working relationship that tends to force the side bar outward and into the rectangular notch. [In the specific lock of the present invention, the side bar has a rectangular surface adapted to fit into the rectangular notch of the housing, and an opposed wedge shaped surface adapted to fit into V-shaped notches in the tumblers]. As is known to those skilled in the art, each tumbler has a V-shaped notch, on a side perpendicular to the surface that contacts the tumbler springs, for receiving the wedge shaped surface of the side bar. When the V-shaped notches of the tumblers are not aligned, the tumblers force the side bar out of the plug into the rectangular notch in the housing. When the key is inserted into the lock, aligning the V-shaped notches on the tumblers, the side bar spings force the wedge shaped surface of the side bar into the aligned V-shaped notches of the tumblers, which causes the side bar to draw back flush with the outside diameter of the plug, making it possible to rotate the plug in the housing.

In the assembly of the prior art lock, the tumblers are placed in the plug in a row on a line parallel to the center line of the cylinder of the plug, and tumbler springs, which control the position of the tumblers when the key is not in the lock, are placed on top of the tumblers. A single spring retainer, comprising a U-shpaed piece of metal having an elongated middle section, and two short perpendicular ends [legs] which are adapted to fit into slots in the plug at each end of the row of springs, is tapped into the slots, and the metal of the plug is slaked [deformed] to hold the legs of the spring retainer in the plug.

It has been found that a deformation of a small portion of the somewhat brittle metal of the plug, in many cases is not sufficient to hold the spring retainer in place. The spring retainer can break loose quite easily, without trauma, even on brand new cars. When the spring retainer breaks loose, the tumbler springs push the spring retainer up causing it to act like a side bar, and the lock freezes up. Consequently, many motorists have started their cars without trouble, have taken a short trip, and found they cannot turn off their engines.

Others have stopped their engines for a few minutes, to get gasoline for example, and found they could not start them up again. Similarly, some people who have gone to the supermarket and placed their frozen foods and ice cream in the truck, have found after an uneventful five minute trip home, that they could not reopen their trunk. The same problem often occurs in door locks.

Of course, when such a problem occurs, a locksmith is needed to repair the lock. Since the swaging of the metal of the plug often provides a weak hold on the spring retainer, locksmiths are frequently called back a second time to do the same job on the same lock, and must consequently absorb the loss to their business for the time and work of a callback.

In addition, such a problem affects the profits of the auto manufacturer since the manufacturer must absorb the cost of fixing the problem when the car is still under warranty.

SUMMARY OF THE INVENTION

It is a feature of the present invention to overcome the deficiencies of the prior art side bar wafer lock and its spring retainer described above.

The present invention provides a side bar wafer lock, as described above, in which an improved spring retainer is used. The improvement in the spring retainer comprises barbs on the legs thereof that hook into the softer metal of the plug when the spring retainer is in place. It has been found, that in the illustrated embodiment, it is advantageous that the spring retainer be made of a material that is harder than the metal used to make the plug and has an elastic modulus that makes it possible to deform the retainer and have it spring back to its original shape, and as an example, spring steel has been used to make the spring retainer. In the illustrated embodiment, four or six barbs have been used on each leg of the spring retainer, and said legs, when measured across the barbs, have been made wider than the slot in the plug in which they are placed.

The method of using the spring retainer of the invention in the lock of the invention comprises the steps of forcing the spring retainer into the plug of the lock, and releasing the spring retainer, permitting an outward force to be exerted on the spring retainer by the tumbler springs, causing the barbs on the spring retainer to bite into the softer metal of the plug.

Other details, features, objects, uses and advantages of this invention will become apparent from the embodiments thereof presented in the following specification, claims and drawings.

DESCRIPTION OF THE PREFERRED EMBODIMENT

Figure 1:
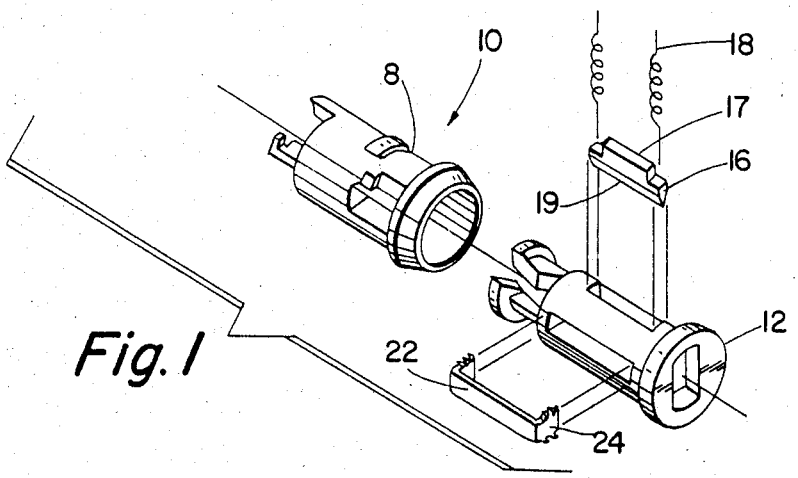
FIG. 1 illustrates an exploded perspective view of the side bar wafer lock, illustrating interior parts of the lock.
Figure 2:
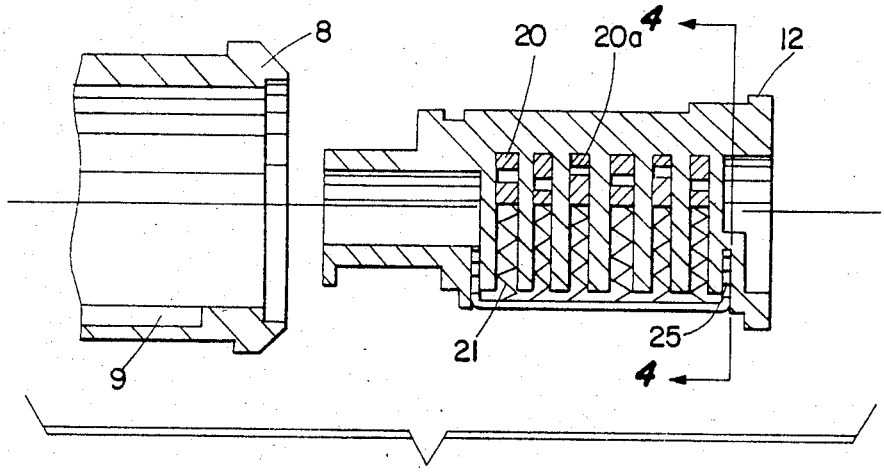
FIG. 2 illustrates an exploded side view of the lock.

Reference is now made to FIGS. 1 and 2 which illustrate a side bar wafer lock of the invention and important parts thereof. The side bar wafer lock 10 comprises a housing 8 with rectangular notch 9, for receiving plug 12, a side bar 16 with rectangular surface 17 adapted to fit into rectangular notch 9, side bar springs 18 inserted between the inside surface of the plug and side bar 16 for exerting an inward force on said side bar, a wedge shaped surface 19 of side bar 16 which provides a working relationship between the tumblers and side bar, tumblers 20 having V-shaped notches 20*a* adapted to receive wedge shaped surface 19, tumbler springs 21 for forcing the tumblers toward the center of the plug into a positon that tends to force the side bar 16 outward into rectangular notch 9 by resisting alignment of V-shaped notches 20*a*, and spring retainer 22 which has legs 24 adapted for placement in the slots 25 of plug 12 to hold tumbler springs 21 in place.

Figure 3:
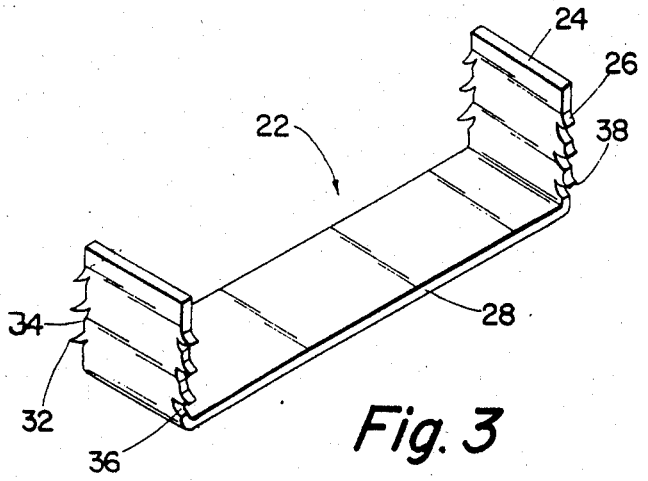
FIG. 3 illustrates the improved spring retainer of the invention.

Reference is now made to FIG. 3 which illustrates the improved spring retainer of the invention. The spring retainer 22 has a U-shape comprising as elongated middle section 28, rectangular legs 24 substantially perpendicular to elongated middle section 28, and barbs 26 on said legs. The barbs 26 are formed by placing angled cuts 36 in the legs. The cuts 36 are angled such that the leading edge 32 of the cut is closer to the middle section 28 than is the interior and 34 of the cut. That is, the cut 36 is angled downward, producing an upward angled barb 26.

It has been found that by providing barbs 26 on a standard prior art spring retainer, which is made of relatively soft metal, having little elastic modulus, that the holding power of the spring retainer is improved. In the illustrated embodiment, the plug 12 has slots 25 which are 0.185 to 0.190 inch wide and a standard spring retainer has legs having a width of about 0.185 inch. When barbs 26 are cut into legs 24 of a standard size, the process of cutting the barbs increases the width of the legs to about 0.220 to 0.230 inch. Because the legs 24 are easily compressed around cuts 36, this makes possible the entry of the oversized legs 24 into slots 25. This causes a tighter fit between legs 24 and slots 25.

Figure 4:
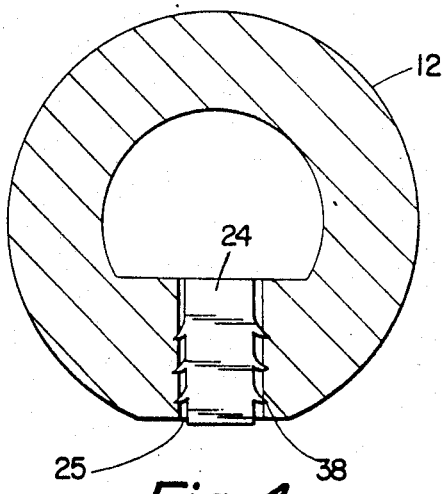
FIG. 4 illustrates a section 4—4 of FIG. 2.

In the method of the present invention, after the tumbler springs are in place in the prior art assembly, spring retainer 22 is force (inserted) into the slots 25 of plug 12 (no slaking need take place as was done in the prior art). Because of the angle of the cut 36, the leg 24 with barbs 26 is easily compressed around cuts 36, and enters smoothly into slot 25. As soon as any outward force is exerted on spring retainer 22, such as is caused by the tumbler springs, leading edge 38 of barb 26 snags the metal of plug 12 and leg 24 expands, causing spring retainer 22 to bite or hook the relatively soft metal of plug 12, holding the spring retainer 22 firmly in place, as is illustrated in FIG. 4.

The hold of the sping retainer 22 is further improved when the spring retainer is made of a material that is harder than the material of the plug 12. The spring retainer is even further improved when it is made from a material that has an elastic modulus such that its shape is retained, that is it spring back into shape, when it is deformed as it is forced into slots 25 of plug 12.

In the illustrated embodiment, spring steel is used to make the improved spring retainer 22. Using such a material in an spring retainer 22 having oversized (larger than slot 25) legs 24, makes it possible to compress barbs 26 as the legs 24 are inserted into smaller slot 25, yet the elastic modulus of the material causes the barbs 26 to tend to expand to their original shape when the force of compression is released. The more outward pressure exerted on spring retainer 22, the more legs 24 expand, such that the only way that spring retainer 22 can be removed is to tear away the metal from the edge of slot 25.

Any material having a hardness greater than that of the plug, and an elastic modulus such that it has a tendancy to retain its shape when compressed, will be suitable for making the spring retainer of the invention.

In the illustrated embodiment, the spring retainer of the invention has six barbs on each leg 24. Those skilled in the art will recognize that the invention can be practiced using one or two barbs, or many barbs in a saw toothed arrangement.

While present embodiments of the invention and methods of practicing the same have been illustrated and described, it will be recognized by those skilled in the art that this invention may be otherwise variously embodied and practiced within the scope of the following claims.

What is claimed is:

1. In a side bar wafer lock consisting essentially of a housing; a metal plug adapted to fit into said housing and having at least one slot for receiving a spring retainer; a side bar, side bar springs, tumblers, and tumbler springs in a working relationship in said plug for controlling the movement of said side bar; and a spring retainer having at least one leg adapted to be inserted into said slot, for holding the tumbler springs in said plug, the improvement comprising a U-shaped spring retainer having barbed legs wherein barbs on said legs are formed by placing angled cuts in said legs and said barbs increase the width of said legs to a width wider than said slot when measured across said barbs, and wherein said barbs are upward angled and compress when said legs are inserted into said slot.

2. The side bar wafer lock of claim 1 in which said spring retainer is made of a material which is harder than said plug.

3. The side bar wafer lock of claim 1 in which said spring retainer is made of spring steel.

4. In a spring retainer having a U-shape and an inside surface comprising an elongated rectangular middle section and two rectangular legs attached at each and substantially perpendicular to said middle section, each leg of said spring retainer being adapted to be inserted into a slot of a plug, the improvement comprising barbs on said legs wherein said legs are wider than said slot when measured across said barbs.

5. The spring retainer of claim 4 in which said spring retainer is made of a material which is harder than said plug.

6. The spring retainer of claim 4 in which said spring retainer is made of spring steel.

7. The spring retainer of claim 4 in which each leg of said spring retainer has four barbs.

8. The spring retainer of claim 4 in which said legs have a width wider than said slot.

9. The spring retainer of claim 4 which is made of a material having an elastic modulus such that it tends to retain its shape when the legs of said spring retainer are inserted into said slot.

10. The spring retainer of claim 4 in which said barbs of said legs bite into the casting of the slots of said plug.

11. In a method of retaining the tumbler springs in a side bar wafer lock consisting essentially of a housing adapted to receive a plug; a metal plug having at least one slot for receiving a spring retainer; a side bar, side bar springs, tumblers, tumbler springs which have a working relationship for controlling the movement of said side bar in said plug; and a spring retainer having a U-shape and an inside surface comprising an elongated rectangular middle section and two rectangular legs attached at each end substantially perpendicular to said middle section adapted to retain said tumbler springs in said plug, said legs being adapted to be inserted into slots in said plug; which comprises the steps of providing at least one barb on each leg of said spring retainer, forcing the legs of said spring retainer into said slots, and releasing said spring retainer and permitting the tumbler springs to push the spring retainer outward, causing said barbs to bite into the metal of the slot of said plug.

12. The method of claim 11 which comprises the further step of making said spring retainer of a material which is harder than said plug.

13. The method of claim 11 which comprises the further step of making said spring retainer of spring steel.

14. The method of claim 11 which comprises the further step of providing four barbs on each leg.

15. The method of claim 11 which comprises the further step of making said legs with a width wider than said slot.

16. The method of claim 11 which comprises the further step of making said spring retainer from a material that has an elastic modulus such that it tends to retain its shape when the leg of the spring retainer is forced into said slot.

17. In a side bar wafer lock consisting essentially of a housing; a metal plug adapted to fit into said housing and having at least one slot for receiving a spring retainer; a side bar, side bar springs, tumblers, and tumbler springs in a working relationship in said plug for controlling the movement of said side bar; and a spring retainer having at least one leg adapted to be inserted into said slot for holding the tumbler springs in said plug, the improvement comprising a spring retainer having a barbed leg, wherein said barbed leg has a width greater than that of said slot and wherein the barb of said leg bites into the casting of said slot.

* * * * *